US005095724A

United States Patent [19]

Lainhart

[11] Patent Number: 5,095,724

[45] Date of Patent: Mar. 17, 1992

[54] TUMBLER WHEEL SCRAMBLER FOR COMBINATION LOCK

[75] Inventor: Gregory C. Lainhart, Nicholasville, Ky.

[73] Assignee: Sargent & Greenleaf, Inc., Nicholasville, Ky.

[21] Appl. No.: 686,923

[22] Filed: Apr. 18, 1991

[51] Int. Cl.[5] ..... E05B 37/08

[52] U.S. Cl. ..... 70/303 R; 70/314; 70/23; 70/323

[58] Field of Search ..... 70/23, 303 A, 303 R, 70/314-318, 321-323, 326, 331, 333 R, 443, 446; 292/337; 16/254, 260, 262, 267-269

[56] References Cited

U.S. PATENT DOCUMENTS

| | | | |
|---|---|---|---|
| 2,224,875 | 12/1940 | Machinist | 70/314 X |
| 2,618,809 | 11/1952 | Rubinoff | 16/267 |
| 2,625,032 | 1/1953 | Eiffert et al. | 70/23 |
| 2,797,840 | 7/1957 | Gibbs | 16/262 X |
| 3,339,382 | 9/1967 | Miller et al. | 70/23 |
| 3,533,253 | 10/1970 | Miller et al. | 70/303 R X |
| 4,147,045 | 4/1979 | Testa | 70/314 |
| 4,163,376 | 8/1979 | Miller et al. | 70/303 A |
| 4,358,871 | 11/1982 | Takai | 16/262 |
| 4,722,207 | 2/1988 | Wertz, Jr. | 70/303 A |
| 4,895,010 | 1/1990 | Legault | 70/314 |
| 4,910,981 | 3/1990 | Gartner | 70/314 |
| 4,961,332 | 10/1990 | Deswarte et al. | 70/303 A |

*Primary Examiner*—Renee S. Luebke
*Assistant Examiner*—Suzanne L. Dino
*Attorney, Agent, or Firm*—Mason, Fenwick & Lawrence

[57] ABSTRACT

A tumbler wheel scrambler assembly for combination locks of the type having a plurality of tumbler wheels and a driving cam arranged in a stack in a lock case with lost motion couplings for rotating the tumbler wheels upon rotation of the driving cam by a dial, and having a slidable bolt and pivoted fence lever for moving the bolt from projected locking position to unlocking position when the proper opening combination has been dialed. The lock case has a scrambler mounting post therein and the scrambler included a two piece housing of mating housing halves collectively defining guide channels for elongated slide members having hook formations protruding into positions to engage with gates of the tumbler wheels for spring forced scrambling of the tumbler wheel positions during displacement of the bolt from projected locking position. The scrambler housing halves have mounting ear formations for collectively encircling the mounting post to pivotally support the scrambler housing from the lock case.

8 Claims, 4 Drawing Sheets

28a
28
32a
32b
32
29a
29
30
33
32b
31
52
55
53
53b
53a
54
56

TUMBLER WHEEL SCRAMBLER FOR COMBINATION LOCK

BACKGROUND AND OBJECTS OF THE INVENTION

The present invention relates in general to combination locks of the tumbler wheel type, and more particularly to the tumbler wheel type combination locks having a scrambler or tumbler upsetting mechanism for displacing the angular positions of one or more of the tumbler wheels during retraction of the lock bolt to unlocked position place the tumbler wheel gates so that they will no longer be disposed in fence-receiving, unlocking alignment when the bolt is returned to projected or locking position.

Conventional combination locks as usually manufactured comprise three or four tumbler wheels which are loosely journalled in a coaxial, side-by-side, spaced stack relationship for rotation within a lock casing on a hollow tubular tumbler post projecting inwardly from the front wall of the tumbler casing. The lock dial, which usually has one hundred peripheral calibration marks thereon, is affixed to a dial spindle which extends through the hollow center of the tumbler post and has keyed to the inner end thereof a drive cam which is likewise arranged coaxially with and spaced rearwardly from the stack of tumbler wheels. Each of the tumbler wheels is provided with a peripheral notch or gate at a selected radial position to receive a fence bar projecting from a fence lever when properly oriented, and the drive cam is similarly provided with a peripheral gate for receiving a nose formation projecting from an end of the fence lever.

A drive pin projects forwardly from the drive cam to provide a lost motion coupling with a conventional fly rotated through a limited arc and associated with the rearmost tumbler wheel to drive the rearmost tumbler wheel in selected relation to the drive cam. A similar lost motion coupling is provided between each of the successive tumbler wheels so that each of the tumbler wheels may be driven upon predetermined rotation of the drive cam. A thin spacer washer is also customarily provided between each of the tumbler wheels, in association with a fly member which typically comprises a ring portion journalled in concentric relation with the associated tumbler wheel and a radial projection which lies between a pair of stop shoulders on the associated tumbler wheel to limit angular rotation of the fly to about 20 degrees. A drive pin or lug projects from the adjacent tumbler wheel into position to abut the radial projection of the fly member and transmit rotation to the adjacent tumbler wheel after the fly member has moved through its predetermined lost motion angular range.

A fence lever is pivotally connected near one end of a reciprocative bolt slidably supported in the lock casing. The fence lever typically has a depending nose formation near the free end of the fence lever to ride upon the drive cam periphery, and the fence lever additionally usually includes a bar or fence projecting laterally from the fence lever in overlying relation to the peripheries of the tumbler wheels. The position of the fence in relation to the length of the fence lever nose is usually such that the fence is spaced outwardly from the peripheries of the tumbler wheels when the fence lever nose rides on the drive cam periphery. Such combination locks are opened by rotation of the dial in a predetermined sequence clockwise and counterclockwise through predetermined numbers of revolutions to numerical positions forming an opening combination, which effects angular rotation of the tumbler wheels to positions resulting in alignment of their peripheral gates with the fence, so that when the dial is then rotated to bring the drive cam gate to a position registered with the fence lever nose, the fence lever nose and fence drop into the gates so that further rotation of the dial through a partial revolution achieves retraction of the bolt. To improve security of the lock against unauthorized entry, it is desirable in many instance to provide some sort of tumbler upsetting mechanism or tumbler scrambling assembly such that, when the bolt is being retracted, one or more of the tumbler wheels is engaged and moved to an upset or changed angular position. Preferably, the tumbler upsetting or scrambler mechanism should be of such a nature as not to necessitate any enlargement of the lock housing or change the relation of the tumblers and the bolt and fence lever from the normal construction of these components.

Heretofore, a number of such tumbler upsetting or scrambler mechanisms have been proposed, for example as shown in the Eiffert et al U.S. Pat. No. 2,625,032, the Miller et al U.S. Pat. No. 3,339,382 and the Miller et al U.S. Pat. No. 3,533,253, all owned by the Assignee of the present application. Such tumbler upsetting or scrambler mechanisms as shown in these prior patents, however, involve modification of some part of the lock mechanism which is moved to affect bolt retraction and projection between locking and unlocking position or special configuration of the interior mechanism chamber of the lock casing so as to accept the tumbler upsetting or scrambler assembly and the bolt or bolt plate in such locks is not spring-biased to the projected or locking position.

An object of the present invention is the provision of a novel tumbler scrambler assembly which is provided as a self-contained assembly insertable in a tumbler wheel type combination lock without significant modification of the usual lock components, and which may be simply assembled onto a pivot post provided in the lock housing.

Another object of the present invention is the provision of a novel tumbler scrambler mechanism for upsetting the angular positions of tumbler wheels of a tumbler wheel type combination lock during retraction of the locking bolt to the withdrawn or unlocking position when the fence leaves the tumbler gates near the end of the bolt-retracting stroke, wherein the tumbler scrambler mechanism is incorporated into mating housing halves which can be readily assembled together and mounted on a supporting post protruding rearwardly from the front wall of the lock casing, and wherein the mating scrambler housing halves have U-shaped mounting ears forming oppositely directed, interfitting protrusions to embrace and assemble the scrambler mechanism onto the mounting post.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figure 1:
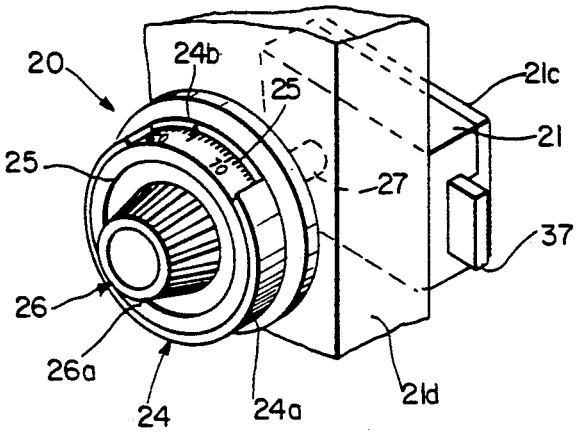
FIG. 1 is a perspective view of a combination lock of the type incorporating the scrambler mechanism of the present invention.

Referring to the drawings, wherein like reference characters designate corresponding parts throughout the several figures, the combination lock of the present invention, indicated generally by the reference character 10, is of the general type disclosed in prior U.S. Pat. Nos. 2,275,674 and 2,807,954 issued to Harry C. Miller, but which includes, in the illustrated embodiment, a torque adjustor spring mechanism of the type disclosed in U.S. Pat. No. 4,163,376 to Miller et al. The combination lock with which the scrambler mechanism of the present invention is associated, in the illustrated embodiment, comprises a substantially rectangular lock case 21, having top and bottom walls 21*a*, 21*b* and a hollow boss or tumbler post projecting rearwardly from the front wall 23 of the lock case. A removable rear cover plate 21*c* is provided to close the rear of the lock case 21. The lock case 21 is designed to be mounted against the inner surface of a door or other security closure in the conventional manner, as by mounting screws extending through screw holes provided in the front wall 23 of the lock case and into the supporting door. Secured to the outer face of the supporting door concentric with the axis of the tumbler post is a dial ring 24, here shown as having a cylindrical shield 24*a* surrounding and shielding from view the major portion of the peripheral flange 25*a* of the dial portion 25 of the dial and knob member 26, the shield 24*a* being interrupted by a sight opening 24*b* of suitable circumferential extent.

The dial and knob member 26 is supported for rotation within the forwardly opening cylindrical well of the dial ring 24 defined by the shield 24*a*, and includes a drive spindle 27 coupled at its forwardmost end to the dial and knob member 26 and extending through the hollow tubular post 22 to be rotatably journalled by the tumbler post. The dial and knob member 26 has an integral knob portion 26*a* thereon which projects forwardly from the dial portion 25 and preferably has a knurled periphery to facilitate manipulation of the dial and knob member 26.

The rearmost end of the drive spindle 27, in the illustrated embodiment, is threaded into an internally threaded portion of a tubular boss formation projecting forwardly integrally from the driving cam 28, and these components are keyed together at the desired angle position by inserting a suitable spline key into a radial groove in the center bore of the driving cam which is aligned radially with the spline key and with a curve in the spindle 27, all as described in U.S. Pat. No. 4,163,376.

The stack or array of tumbler wheels, for example a three wheel stack indicated by reference characters 29, 30 and 31, are supported to rotate freely on the tumbler post 22. Each of the tumbler wheels 29, 30 and 31 are of the conventional type designed to be changed by means of a resetting key to vary the combination of the lock, and to this end comprise an inner hub on which is supported a pair of annular discs having a tumbler gate or peripheral recess, as indicated at 29*a*, the outer annular discs being selectively locked against rotation relative to their associated hub by a conventional locking lever pivotally supported between the pair of annular discs on each hub and engaging peripheral teeth on the hub to hold the annular discs at a selected angular position. Conventional flies 32, each consisting of an annular ring 32*a* and an outwardly protruding radial projection 32*b*, are provided between the pairs of tumblers 31–30, 30–29, and the tumbler 29 and driving cam 28, and an annular spacer washer 33, for example having an inner diameter conforming to the outer diameter of the tumbler post 22 and having a pair of inwardly projecting lugs extending into grooves on the post to prevent its rotation, is provided between each tumbler wheel pair. To provide for adjustment of the tension forces on the tumbler wheel stack governing the torque characteristics or properties of the stack, the rearwardly facing surface of the front wall of the lock case is provided with a circumferentially arranged series of arcuate ramp segments, indicated at 34, arranged in an annular path concentric with and outwardly surrounding the tumbler post, providing ramp surfaces progressively rising rearwardly from a forwardmost, deeper ramp end portion to a rearmost, shallower ramp portion substantially flush with the remainder of the rear surface of the front casing wall 23. Bearing against the inclined ramp surfaces and interposed between the ramp surfaces and the forwardmost surface of the forwardmost tumbler wheel 31 is an angularly adjustable, rotatable torque adjustor member 35 having circumferentially extending spring finger formations 35*a* bent along forwardly inclined paths of greater slope than the inclined ramp surfaces 34 to track on the ramp segment surfaces. This torque adjustor mechanism and suitable means for adjusting the angular position of the torque adjustor member are described fully in the previously identified U.S. Pat. No. 4,163,376.

The lock is also provided with a bolt 37 which is adapted to slide in a suitable guideway 38 formed in an end wall 21*d* of the lock case. The bolt 37 is operated by means of a fence lever 39 which is pivotally to the bolt by means of a screw 39*a* and is normally urged downwardly by the lever spring 40, which, in the illustrated embodiment, is interconnected between the fence lever 39 and the relock lever 41 biased by its lever spring 42 and pivoted on the stud 43. The spring biased relock lever 41, as will be appreciated by persons skilled in the art, has an end portion 41*a* bearing against the removable rear cover plate of the lock casing and another end portion 41*b* forming a tongue which is normally spaced from the bolt 37 but is allowed to enter a locking recess in the bolt 37 to lock the bolt in projected or locking position when the cover plate is removed.

The fence lever 39 is provided with a laterally projecting bar 39*b* commonly referred to as a fence, which projects along an axis parallel to the axis of the drive spindle and overlies the peripheries of all the tumbler wheels 29, 30 and 31. The fence 39*b* is adapted to be received in the peripheral gates, such as gate 29*a*, of the tumbler wheels when the tumbler wheel gates are disposed in registry with each other at a chosen angular position upon operation of the dial and knob member 26 to the proper opening combination for the lock. When the dial and knob member 26 is rotated in the proper manner to so register the tumbler wheel gates with the fence, and is then operated to locate the gate in the drive cam 28 below the fence lever nose, the fence lever nose 39*c* descends into the driving cam gate 28*a* by action of the fence lever spring 40 and further predetermined rotation of the driving cam by rotation of the dial and knob member 26 effects retraction of the bolt.

In the illustrated embodiment, the bolt 37 is spring biased to the projected or locking position by the bolt spring 45, and is provided with a dead bolt rocker member 46 pivoted to a mounting block formation on the bolt 37 by a rocker pin 47 to coact with a strike plate 48 biased by a strike plate spring 48*a*. A rocker plunger member 49 is slidably received in a bore or socket therefore in the mounting block formation 50 on the bolt 37 and biased outwardly by an associated spring 49*a*. The action of the dead bolt rocker 46, strike plate 48 and rocker plunger 49 correspond to the locking bar 51, actuating member 55 and piston 81 described in U.S. Pat. No. 4,895,010 to LeGault, assigned to the Assignee of the present application, and serve the purpose and operate in the manner described in that LeGault patent.

Figure 2:
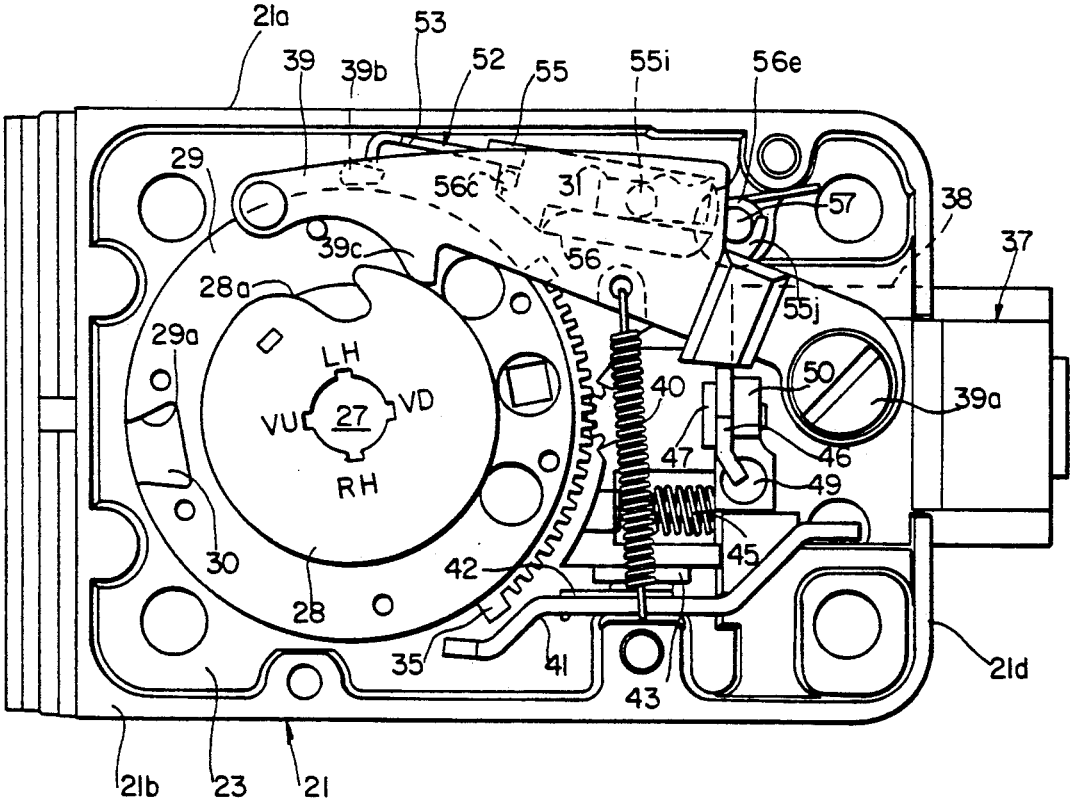
FIG. 2 is a rear elevational view of the combination lock with the rear cover removed, showing the lock in locked condition.
Figures 3, 3A, 3B:
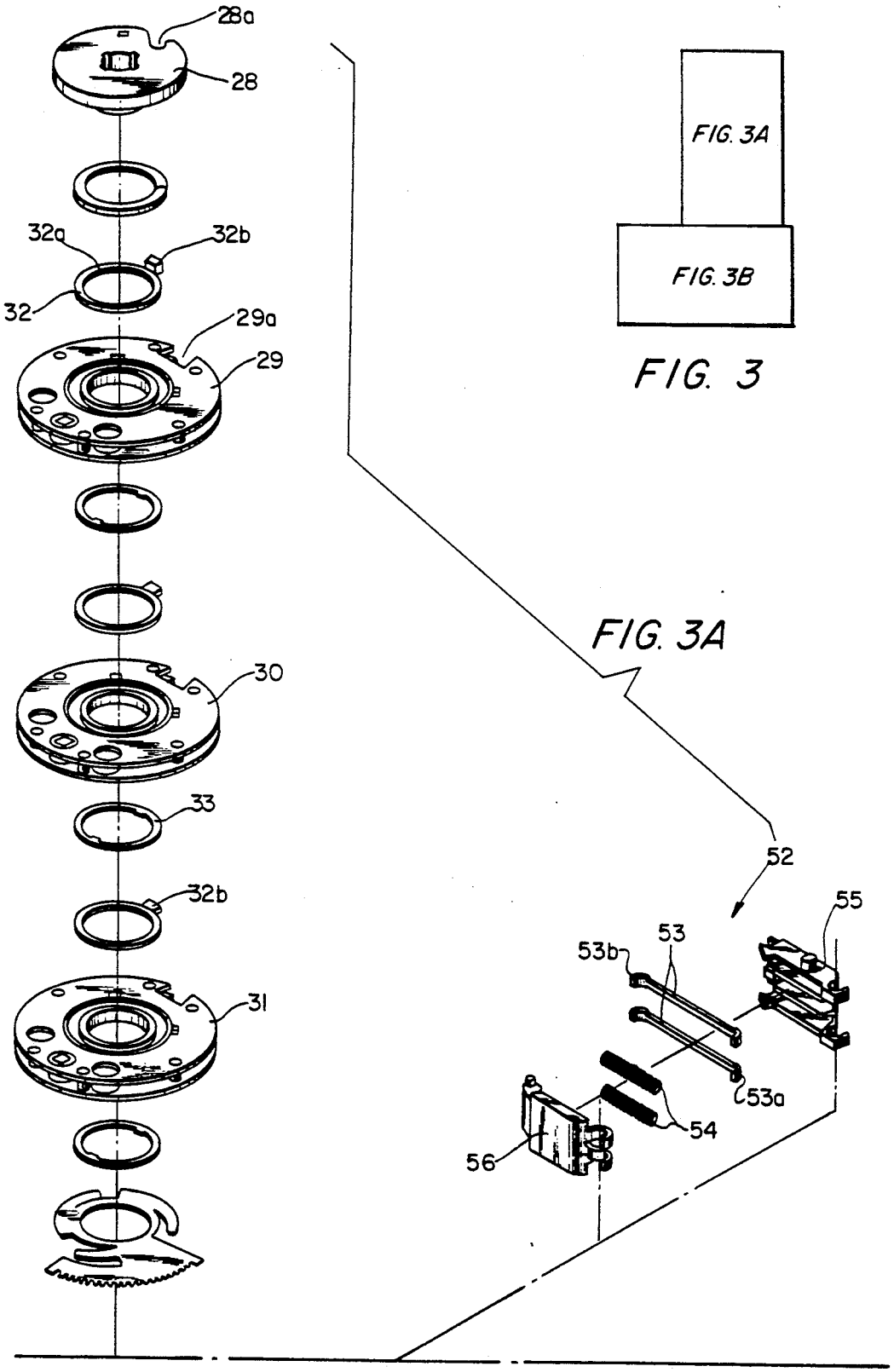
FIG. 3 is an exploded perspective view of the principal components of the combination lock and scrambler mechanism of the present invention.
Figure 3B:
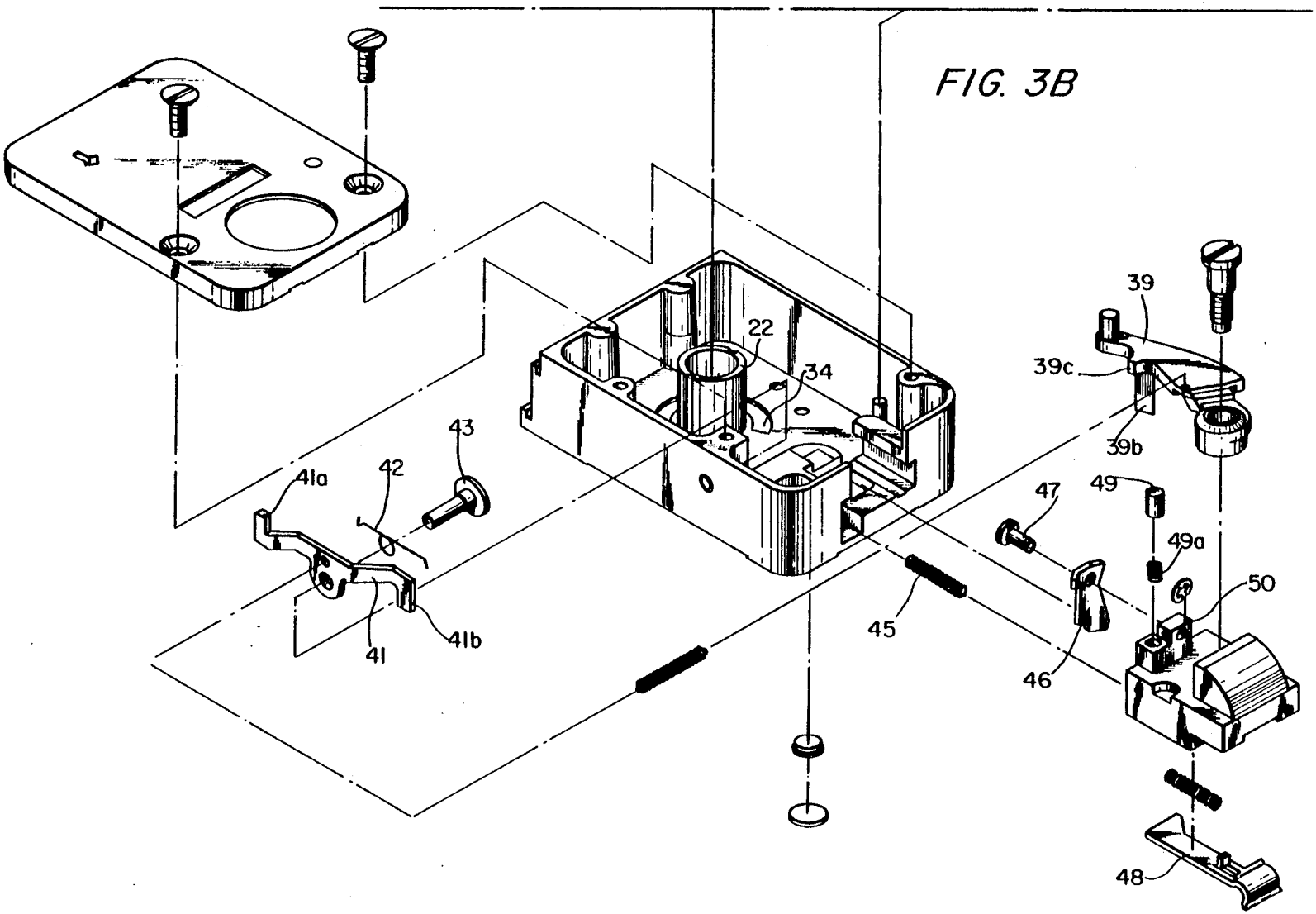
Figure 4:
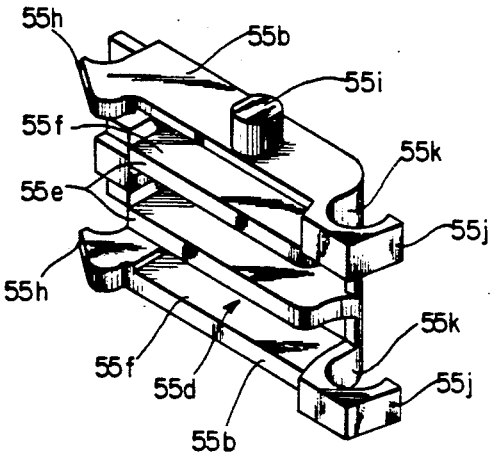
FIG. 4 is a perspective view of one of the mating halves of the housing for the scrambler mechanism.
Figure 5:
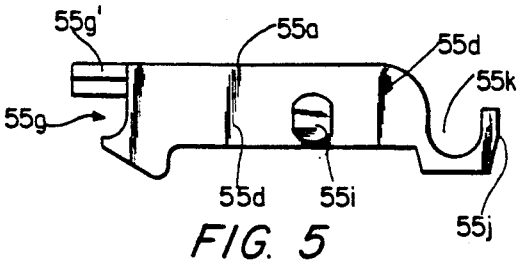
FIG. 5 is a rear elevational view thereof.
Figure 6:
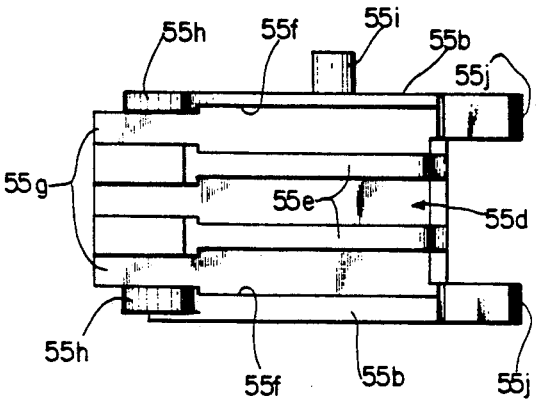
FIG. 6 is a bottom view of the mating housing half shown in FIG. 4.

The scrambler assembly of the present invention to be incorporated in the combination lock for upsetting the angular positions of the tumbler wheels 29, 30 and 31 is indicated generally by the reference character 52 and comprises, in the illustrated embodiment, a pair of elongated movable hook members 53 and associated coil springs 54 assembled in a housing formed of two housing sections indicated by the reference characters 55 and 56. The housing section 55, which is also shown in detail in FIGS. 4, 5 and 6, forms the upper housing section when the lock occupies the orientation or position shown in FIG. 2, and comprises a generally boxlike case or housing section having a top wall 55*a*, and front and rear side walls 55*b*, 55*c* defining a downwardly opening cavity 55*d* subdivided by thin partition formations 55*e* to define a pair of elongated channels 55*f* of generally rectangular cross section which open through the end 55*g* toward the tumbler wheels to permit passage of the hook shaped slide members 53 therethrough. A pair of interlocking ear formations 55*h* flank the front and rear of the open end 55*g* to receive stub shafts 56*c* as herein described protruding from a corresponding end portion of the companion mating housing section 56 to pivotally interlock the two housing sections 55, 56 together at the end 55*g*. A stub shaft formation 55*i* protrudes rearwardly from the rear side wall 55*c* of the housing section 55, and a pair of interfitting substantially U-shaped partially encircling coupling formations 55*j* protrude from the opposite end 55*k* of the housing section 55 to coact with similar but oppositely directed substantially U-shaped partially encircling coupling formations on the companion housing section 56 to collectively wrap around and pivotally assemble the housing onto the mounting post 57 protruding from the front wall 21*c* of the lock casing.

Figure 7:
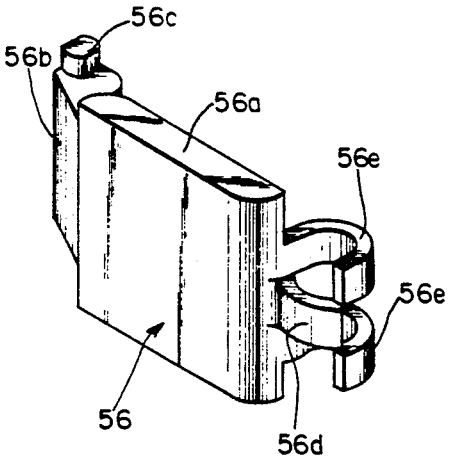
FIG. 7 is a perspective view of the other housing half.
Figure 8:
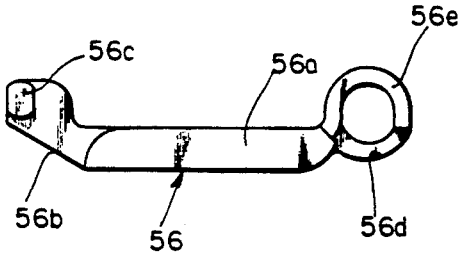
FIG. 8 is a rear elevational view of the housing half shown in FIG. 7.
Figure 9:
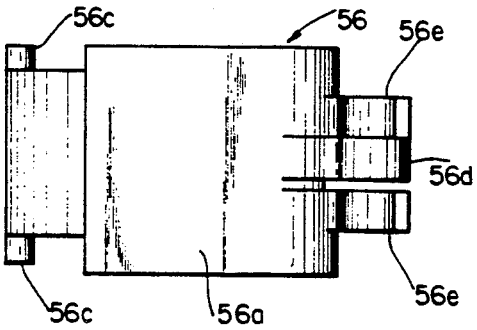
FIG. 9 is a bottom view of the housing half shown in FIG. 7.

The companion scrambler mechanism housing section 56, as illustrated more particularly in FIGS. 7, 8, and 9, forms a pivotally associated cover plate closure for the cavity of the companion housing section 55 and includes a generally rectangular closure plate portion 56*a* substantially coextensive with and adapted to be aligned with and spaced in parallelism from the wall 55*a* of the companion housing section 55. An extension 56 protrudes at one end from housing section 56 corresponding to the end 55*g* of the housing section 55 and is provided with stud shafts 56*c* protruding from the opposite lateral edges thereof to be received in the recesses defined by the curved edges of the interlocking ear formations 55*h* of the companion section and the protruding lip 55*g*'. The opposite end of the closure plate portion 56*a* of the housing section 56 has a medial curved tongue formation 56*d* providing an arcuate downwardly concave surface corresponding to and registering with the curved bottom portions of the recesses defined by the U-shaped partially encircling coupling formations 55*j* of the companion housing section 55 to conform to and rotatably abut a confronting portion of the stationary mounting post 57. A pair of substantially U-shaped concave arcuate coupling fingers or protrusions 56*e* extend in flanking relation to the centrally disposed tongue formation 56*d* and curve in the opposite direction to the curved recesses defined by the coupling formations 55*j* of the companion housing section so as to collectively with the formation 55*j* encircle the stationary mounting post 57 and pivotally support the assembled housing sections thereon. The downwardly directed hook-shaped ends 53*a* at one end of the hook-shaped slides 53 and adjacent portions of the straight elongated main portion of each associated slide lie within an associated one of the channels 55*d* defined by the housing section 55 and is spring biased to a retracted position shown in FIG. 2 by the coil spring 54 likewise captured in associated channel 55*d*. The opposite end of the hook-shaped slide member also has a hook formation 53*b* thereon which depends downwardly to be received in the tumbler wheel gate, for example the gate 29*a* or 31*a* of an associated one of tumbler wheels 29, 30, 31 when the fence lever 39 is lowered to position the fence 39*b* in the tumbler wheel gates after rotation of the tumbler wheels to the proper aligned position receive the fence. The hook-shaped slide members 53 and their housing 52 are normally disposed in the raised position shown in FIG. 2 by reason the stub 56*c* protruding into the cavity 39*d* opening toward the housing 52 and located in the confronting face of the fence lever 39. When the proper combination has been dialed and the drive cam 28 positioned to receive the fence lever nose 39*c* in the drive cam gate 28*a*, the downward movement of the fence lever 39 by spring 40 brings the upper surface of cavity 39*d* against stub 55*i* and swings the scrambler housing 52 downwardly to project the hook formations 53*b* into the aligned tumbler wheel gates 29*a*, etc., whereupon the hook shaped slide members 53 are drawn to the left to an extended position against the force of the associated springs 54 during movement of the tumbler wheels 29–31 and driving cam 28 to bolt retracting position. Concurrently, during the downward movement of the fence lever 39, the rearwardly protruding hammer or shoulder formation 39*h* on the near surface of the fence lever strikes the angulated edge 46*a* and causes the locking bar 46 to pivot in a direction to retract the opposite end of bar 46 from the locking cavity in the bolt receiving guide channel, similar to the action described at column 6, lines 47–57 in the identified earlier U.S. Pat. No. 4,895,010. The consequent stressing or spring loading of the springs 54 in the scrambler housing 52 stores energy in these springs which is released to disrupt the tumbler wheel positions and spin the tumblers to disarrange the combination when the fence leaves the gates near the end of the bolt retraction stroke during movement of the fence lever 39 and bolt 37 to the fully unlocked or retracted position. It will be appreciated that during this retraction of the fence lever 39 and bolt 37 to the unlocking position, the tumbler wheels 29, 30 and 31 are effectively released as soon as the fence 39*b* rises out of their peripheral gates, thus permitting the spring force stored in the compression springs 58 to rapidly move the hook-shaped slides 53 back to their normal retracted positions which exerts a clockwise rotating force on the engaged tumbler wheels and spins them to disaligned condition.

I claim:

1. In a combination lock having a lock case provided with front and rear walls and a tumbler post extending along a tumbler axis perpendicularly from said front wall, plural peripherally gated tumbler wheels loosely journalled on said tumbler post, a peripherally gated rotatable driving cam and a rotatable dial for rotating the tumbler wheels to an aligned lock-opening position upon rotation of the dial through an opening combination sequence, and a fence lever pivotally connected to a slidable bolt and having a fence bar to be received in the tumbler wheel gates when adjusted to said lock-opening position for retraction of the fence lever and bolt to unlocking position during predetermined rotary movement of the dial and driving cam between unlocking and locking positions; the improvement comprising a tumbler wheel scrambler mounted inside the lock case, a mounting post for said scrambler extending from one of said walls in parallelism with the tumbler axis, the scrambler comprising a scrambler housing and tumbler wheel engaging slide members extending therefrom for engaging at least some of said tumbler wheels, the scrambler housing having an internal cavity provided with guide channels for guiding the slide members for rectilinear reciprocative movement in extended planes of associated ones of said tumbler wheels, the slide members being spring biased to retracted positions from their associated tumbler wheels and having hook formations at their outer ends for engaging the gates of their associated tumbler wheels and displacing them to non-aligned positions during said predetermined rotary movement when the fence bar withdraws from the gates, and said scrambler housing having oppositely curved mounting ear formations protruding from an end thereof opposite the end from which the slide members extend to collectively form a post-encircling assembly receiving said mounting post therethrough and pivotally supporting the scrambler thereon.

2. A combination lock as defined in claim 1, wherein said scrambler housing is a two-piece housing of mating housing halves having the mounting ear formations of each housing half curving concavely toward the companion mating housing half to receive the mounting post there-between during assembly of the housing halves together to collectively envelop the mounting post.

3. A combination lock as defined in claim 1, wherein said housing has partition formations therein defining a plurality of elongated rectilinear channels corresponding in number to the slide members to slidably receive and guide an end of the associated slide member therein and house a spring connected to the last-mentioned end of the associated slide member and exert retractive biasing forces thereon.

4. A combination lock as defined in claim 2, wherein said housing has partition formations in a first housing half to define plural elongated channels therein corresponding in number to the number of slide members to slidably receive and guide an inner end of the slide member therein, the other housing half forming a closure plate closing the channels to capture the inner end of the slide member therein together with an associated coil spring connected to said inner end.

5. A combination lock as defined in claim 1, wherein said scrambler housing is formed of two companion mating housing halves including a first housing half having a pair of substantially U-shaped partially encircling coupling formations protruding from an end of the first housing half opposite the end from which the slide members extend and a second housing half having at least one substantially partially encircling coupling formation curving opposite to the coupling formations of said first housing half, the coupling formations collectively coacting to form a circle to wrap around said mounting post and pivotally support the scrambler housing thereon.

6. A combination lock as defined in claim 5, wherein said first housing half has elongated rectilinear partition formations therein to define elongated rectilinear channels for the respective slide members to slidably receive and guide inner end portions thereof and receive coil springs for the respective slide members therein, and the other housing half forming a substantially flat closure plate closing the channels to capture the inner end portions of the slide members and their coil springs therein.

7. A combination lock as defined in claim 5, wherein said mating housing halves have an opening through a second end thereof for passage of the slide members therethrough and are flanked by interlocking ear formations shaped to receive and pivotally interlock with stub shafts protruding laterally from one of said mating halves to pivotally interlock the companion mating housing halves together at said second end.

8. A combination lock as defined in claim 2, wherein one of said housing halves defines an opening at a second end thereof for passage of said slide members therethrough flanked by a pair of interlocking ear formations shaped to receive a pair of laterally protruding stub shafts of the other housing half to pivotally interlock the companion mating housing halves together at said second end.

* * * * *